US006324995B1

(12) United States Patent
Kaufhold et al.

(10) Patent No.: US 6,324,995 B1
(45) Date of Patent: Dec. 4, 2001

(54) RAILWAY CAR CENTER FILLER PLATE

(75) Inventors: Horst T. Kaufhold, Aurora; Douglas L. Compton, Bolingbrook; Leonard D. Thomason, Collinsville; Jeffery R. Ladendorf, Mount Prospect; Brian A. Toussaint, Bolingbrook, all of IL (US)

(73) Assignee: Amstead Industries Incorporated, Chicago, IL (US)

( * ) Notice: Subject to any disclaimer, the term of this patent is extended or adjusted under 35 U.S.C. 154(b) by 0 days.

(21) Appl. No.: 09/326,766

(22) Filed: Jun. 4, 1999

(51) Int. Cl.[7] ..... B61F 5/16

(52) U.S. Cl. ..... 105/199.4; 105/226

(58) Field of Search ..... 105/199.4, 226; 384/422

(56) References Cited

U.S. PATENT DOCUMENTS

| | | | | |
|---|---|---|---|---|
| 3,664,269 | | 5/1972 | Fillion | 105/199 |
| 3,831,530 | * | 8/1974 | Cope et al. | 105/199 C |
| 4,056,065 | * | 11/1977 | Fiegl et al. | 105/199 C |
| 4,252,068 | * | 2/1981 | Nolan | 105/420 |
| 4,744,308 | * | 5/1988 | Long et al. | 105/199.4 |
| 5,704,296 | * | 1/1998 | Gagliardino et al. | 105/420 |

OTHER PUBLICATIONS

Amsted Industries, Inc., Commercial Center Filler Plates, Oct. 6, 1999, pp. 1–2.

* cited by examiner

*Primary Examiner*—S. Joseph Morano
*Assistant Examiner*—Frantz F. Jules
(74) *Attorney, Agent, or Firm*—Edward J. Brosius

(57) ABSTRACT

Center filler plates for mounting on draft sills of railway car underframes are disclosed. The center filler plates have four pockets surrounding a hub. The pockets are shallower than in the prior art, and the walls defining the pockets meet in radii having larger radii of curvature than in the prior art. The shallower pockets and larger radii of curvature facilitate removal of the casting from the molding sand in the cope and drag sections of the mold. The formation of burned-in sand is limited in the present invention, and any burned-in sand that does form is also more easily removed from the center filler plates of the present invention. The base portion of the center filler plates is not as high as in the prior art. The ribs of the center filler plate and the walls of the hub are thicker than in the prior art to provide the needed strength to the center filler plates. In one embodiment, the ribs taper toward the hub, and the hub is shorter than the surrounding web; a tool may be inserted through the kingpin hole, expanded to bear against the tapered surfaces of the ribs; a machine may be used to lift the center filler plate and move it into position on the draft sill. The tool may then be contracted and removed, and the center filler plate may be secured to the draft sill through welding or other techniques.

3 Claims, 6 Drawing Sheets

FIG. 1
PRIOR ART
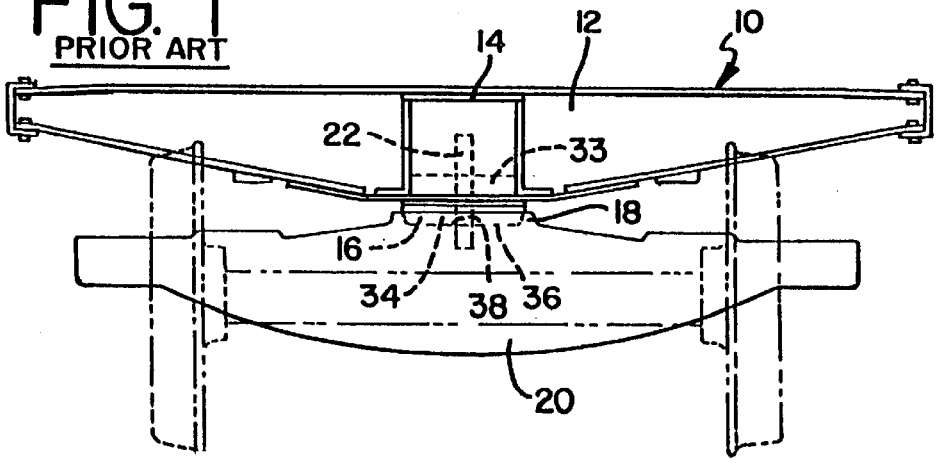
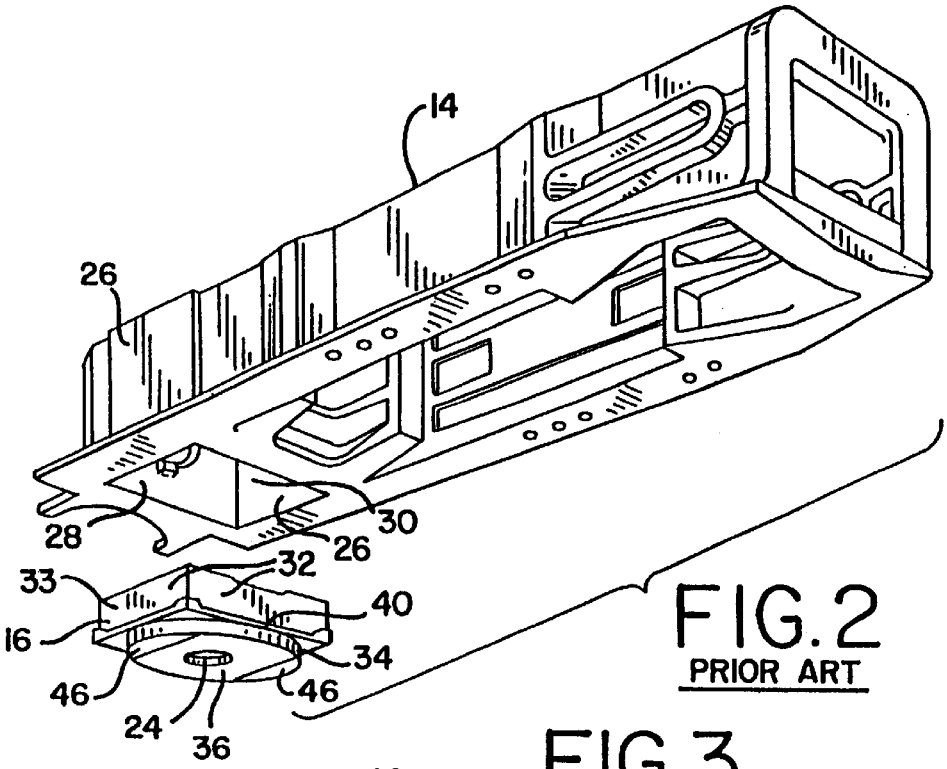
FIG. 2
PRIOR ART
FIG. 3
PRIOR ART
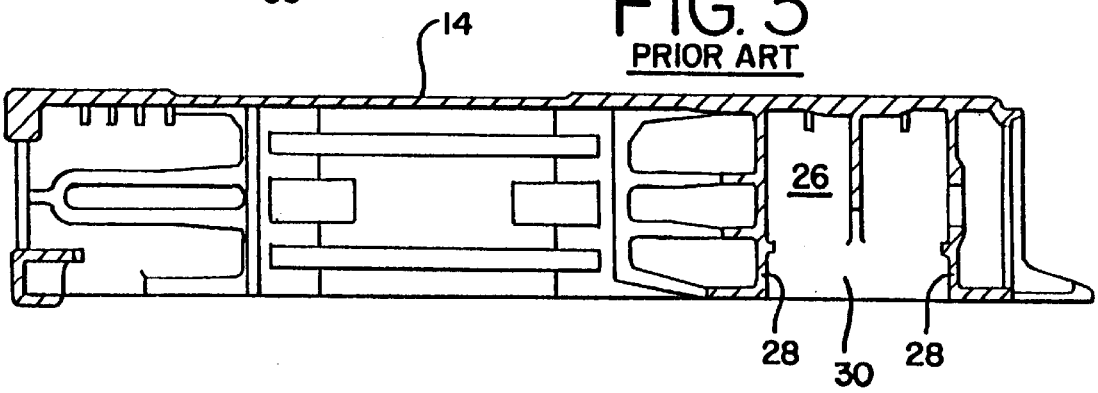

FIG. 19
PRIOR ART
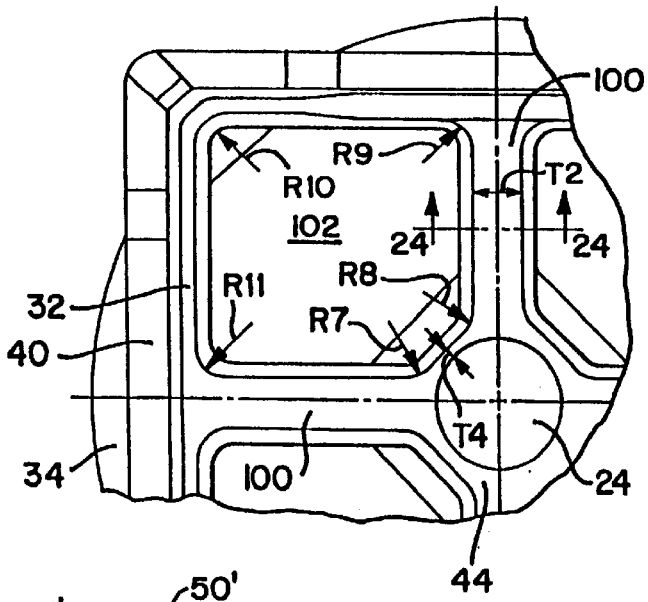
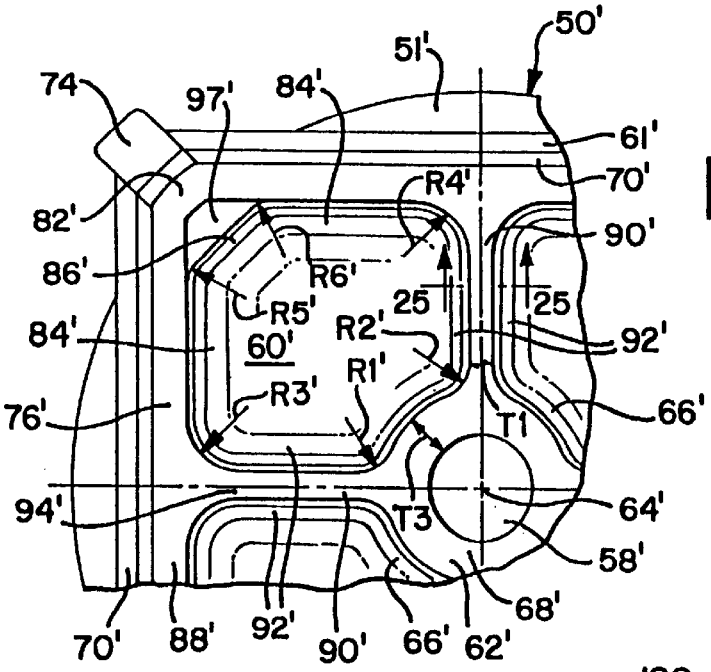
FIG. 20
FIG. 21
PRIOR ART
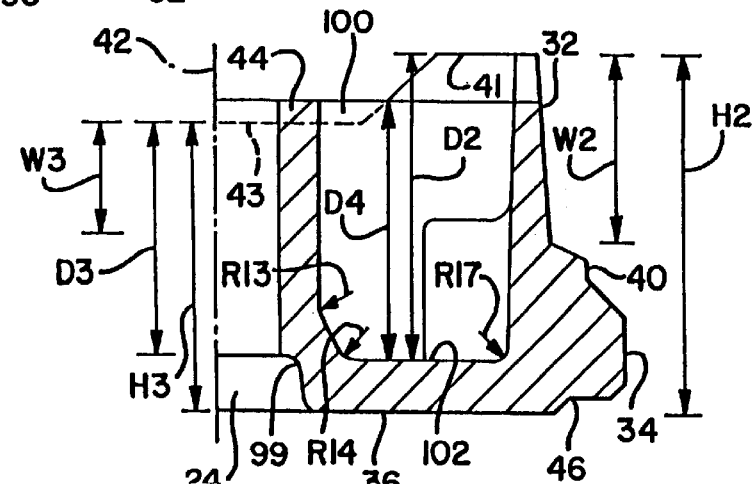

RAILWAY CAR CENTER FILLER PLATE

BACKGROUND OF THE INVENTION

1. Field of the Invention

The present invention relates generally to railway car body underframes for mounting on a bolster of a supporting truck, and more specifically to center filler plates for use with draft sills of such underframes.

2. Description of the Prior Art

Conventionally, the entire weight of railway freight cars is carried on two spaced circular center plates on railway car draft sills. These center plates engage two mating female bowls on cooperating truck bolsters. The trucks include wheel sets, which support the freight car on the railroad track.

Conventional draft sills have been either fabricated or cast of steel. In some cast steel draft sills, the center plates are cast as an integral part of the draft sill. In some other cast draft sills and in conventional fabricated draft sills, a separate center filler plate is welded or bolted to the draft sill. These center filler plates have been advantageous in that they can be removed and replaced as they become worn without requiring replacement of the entire draft sill.

The conventional center filler plates have included base portions that are received within the draft sill above a flange. The flange is typically welded to the outside of the draft sill. Exposed below the flange is the center plate bowl bearing surface that is received within the center plate bowl on the truck bolster. Above the center plate bowl bearing surface is a central hub to receive a part of a king pin when the draft sill is mounted on the car truck. Also above the flange and surrounding the central hub is a generally rectangular outer web connected to the central hub through four spaced ribs. The web and the ribs provide stiffness to the center filler plate to withstand stresses from the vertical loads and the compressive loads from the railway car body bolster. Deep pockets or recesses are defined by the hub, the ribs and the sides of the web.

For handling the center filler plates, prior structures have included feet formed at the corners of the box or outer web to allow for stacking of the center filler plates as well as to provide openings between the feet so that workers could fit their hands in for lifting each center filler plate.

Conventional center filler plates have been made of cast steel. In such casting operations, the deep pockets or recesses in the center filler plate are defined by green molding sand from which the casting must be removed after the casting has cooled. Commonly, identifying marks are cast into the center filler plate in the vicinity of the pockets or recesses.

Finishing the cast center filler plates has been problematic. At casting temperatures, the sand may become burned in, that is, the silica of the molding sand becomes very hard. The burned in sand does not fall out with shaking of the casting, and can ruin cast markings. Removal of burned in sand is a labor intensive operation.

SUMMARY OF THE INVENTION

The present invention addresses the need for a center filler plate from which molding sand or sand cores can be removed with less labor while providing the necessary strength. In addition, one embodiment of the present invention addresses the need for a center filler plate that can be picked up and handled by machine for installation on a draft sill.

In one aspect, the present invention addresses the need for a center filler plate made in a less labor-intensive operation by providing a center filler plate for a railway car comprising a center plate bowl and a center plate base. The center plate bowl includes an exterior bearing surface, a king pin hole at the center of the bearing surface and a plurality of opposite interior center plate bowl surfaces. The center plate base is on the center plate bowl and includes a hollow hub to receive at least a part of a king pin. The hub has a central axis intersecting the exterior bearing surface. The central axis is located at the center of the king pin hole. The hub joins the interior center plate bowl surfaces along radii and has a top opposite the junctures with the interior center plate bowl surfaces. The center plate base has a web that has a plurality of sides. Each side joins at least one of the interior center plate bowl surfaces along a radius. The web has a top opposite the junctures of the sides with the interior center plates surfaces. The center plate base also has a plurality of spaced ribs extending radially outward from the hub to the web. Each rib is positioned between two of the interior center plate bowl surfaces and joins the two interior center plate bowl surfaces along radii. Each rib has a top opposite the junctures with the interior center plate bowl surfaces. At least a part of the hub extends between adjacent ribs and at least a part of the web extends between the adjacent ribs. The center filler plate also has a plurality of pockets. Each pocket corresponds with one of the interior center plate bowl surfaces and extends along at least part of one rib, along at least part of the hub, along at least part of the next rib, and along at least part of the web. Each pocket has a maximum vertical depth from the level of the interior center plate bowl surface to the level of the top of the web at the level spaced furthest from the level of the interior center plate bowl surface. The maximum depth is less than about five inches.

In another aspect, the present invention addresses the need for a center filler plate made in a less labor-intensive operation by providing a center filler plate for a railway car comprising a center plate bowl and a center plate base on the center plate bowl. The center plate bowl includes an exterior bearing surface, a king pin hole at the center of the bearing surface and a plurality of opposite interior center plate bowl surfaces. The center plate base includes a hollow hub to receive at least a part of a king pin. The hub has a central axis intersecting the exterior bearing surface. The central axis is located at the center of the king pin hole. The hub joins the interior center plate bowl surfaces along radii and has a top opposite the junctures with the interior center plate bowl surfaces. The center plate base also has a flange, a web and a plurality of ribs. The flange has a welding surface for welding the center filler plate to the railway car center sill. The web has a plurality of sides. Each side joins at least one of the interior center plate bowl surfaces along a radius. The web has a top opposite the junctures of the sides with the interior center plate bowl surfaces. The ribs extend radially outward from the hub to the web. Each rib is positioned between two of the interior center plate bowl surfaces and joins the two interior center plate bowl surfaces along radii. Each rib has a top opposite the junctures with the interior center plate bowl surfaces. At least a part of the hub extends between adjacent ribs and at least a part of the web extends between the adjacent ribs. The flange is at a level between the level of the exterior bearing surface and the level of the top of the web. The center filler plate also has a plurality of pockets. Each pocket corresponds with one of the interior center plate bowl surfaces and extends along at least part of one rib, along at least part of the hub, along at least part of the next rib, and along at least part of the web. The center filler plate has a maximum height between the level of the exterior bearing surface and the level of the top of the web spaced furthest from the level of the exterior bearing surface. The web has a maximum exterior height between the level of the flange and the level of the top of the web spaced furthest from the level of the exterior bearing surface. The ratio of the maximum height of the center filler plate to the maximum height of the web is at least three to one.

In another aspect, the present invention addresses the need for a center filler plate made in a less labor-intensive operation by providing a center filler plate for a railway car comprising a center plate bowl and a center plate base on the center plate bowl. The center plate bowl has an exterior bearing surface, a king pin hole at the center of the bearing surface and a plurality of interior center plate bowl surfaces opposite the exterior bearing surface. The center plate base has a hollow hub to receive at least a part of a king pin. The hub has a central axis intersecting the exterior bearing surface. The central axis is located at the center of the king pin hole. The hub joins the interior center plate bowl surfaces along radii and has a top opposite the junctures with the interior center plate bowl surfaces. The center plate base also has a plurality of spaced ribs extending radially outward from the hub. Each rib is positioned between two of the interior center plate bowl surfaces and joins the two interior center plate bowl surfaces along radii. Each rib has a top opposite the interior center plate bowl surfaces. The center plate base has a web opposite the hub. The web joins the interior center plate bowl surfaces along radii and has a top opposite the interior center plate bowl surfaces. At least a part of the hub extends between adjacent ribs and at least a part of the web extends between the adjacent ribs. The center filler plate has a pocket corresponding with each interior center plate bowl surface. Each pocket extends between at least parts of one pair of adjacent ribs, the part of the web extending between those ribs, the part of the hub extending between those ribs, and the interior center plate bowl surface joined by radii to the adjacent ribs, the part of the web and the part of the hub. Each of the pockets has: a depth from the level of the top of the one pair of adjacent ribs to the level of the interior center plate bowl surface; a depth from the level of the top of the part of the web extending between those ribs to the level of the interior center plate bowl surface; and a depth from the level of the top of the part of the hub extending between those ribs to the level of the interior center plate bowl surface. For each pocket the ratio of the maximum depth of the pocket to the minimum radius of curvature of the radii at the junctures of the hub, ribs, web and interior center plate bowl surface in the pocket is less than 10 to 1.

In another aspect, the present invention addresses the need for a center filler plate made in a less labor-intensive operation by providing a center filler plate for a railway car comprising a center plate bowl and a center plate base on the center plate bowl. The center plate bowl has an exterior bearing surface, a king pin hole at the center of the bearing surface and a plurality of interior center plate bowl surfaces opposite the exterior bearing surface. The center plate base includes a hollow hub to receive at least a part of a king pin, a plurality of spaced ribs and a web. The hub has a central axis intersecting the exterior bearing surface. The central axis is located at the center of the king pin hole. The hub joins the interior center plate bowl surfaces along radii and has a top opposite the junctures with the interior center plate bowl surfaces. The ribs extend radially outward from the hub. Each rib is positioned between two of the interior center plate bowl surfaces and joins the two interior center plate bowl surfaces along radii. Each rib has a top opposite the interior center plate bowl surfaces. The web is opposite the hub. The web joins the interior center plate bowl surfaces along radii and has a top opposite the interior center plate bowl surfaces. At least a part of the hub extends between adjacent ribs and at least a part of the web extends between the adjacent ribs. The center filler plate has a pocket corresponding with each interior center plate bowl surface. Each pocket extends between at least parts of one pair of adjacent ribs, the part of the web extending between those ribs, the part of the hub extending between those ribs, and the interior center plate bowl surface joined by radii to the adjacent ribs, the part of the web and the part of the hub. The radii joining the hub, ribs and web to the interior surfaces in each of the pockets each has a radius of curvature greater than 0.5 inch.

In another aspect, the present invention addresses the need for a center filler plate that can be handled by a machine for installation on a draft sill by providing a center filler plate for a railway car comprising a center plate bowl and a center plate base on the center plate bowl. The center plate bowl has an exterior bearing surface, a king pin hole at the center of the bearing surface and a plurality of interior center plate bowl surfaces opposite the exterior bearing surface. The center plate base includes a hollow hub to receive at least a part of a king pin, a plurality of ribs and a web. The hub has a central axis intersecting the exterior bearing surface. The central axis is located at the center of the king pin hole. The hub joins the interior center plate bowl surfaces and has a top opposite the junctures with the interior center plate bowl surfaces. The ribs extend radially outward from the hollow hub. Each rib is positioned between two of the interior center plate bowl surfaces and joins the two interior center plate bowl surfaces. Each rib has a top opposite the interior center plate bowl surfaces. The web extends between the ribs opposite the hub. The web joins the interior center plate bowl surfaces and has a top opposite the interior center plate bowl surfaces. The center filler plate has heights between the level of the exterior bearing surface and the levels of the tops of the web, ribs and hub. The height of the center filler plate at the hub is less than the minimum height of the center filler plate at the web. The heights of the center filler plate along the ribs taper from a maximum at the level of the top of the web to a minimum at the hub.

BRIEF DESCRIPTION OF THE DRAWINGS

In the accompanying drawings, like reference numerals have been used for like parts and:

FIG. 1 is an elevation of a railway car body bolster assembled with a draft sill and center filler plate and assembled on a supporting truck bolster;

FIG. 2 is a perspective view of a prior art cast draft sill and associated center filler plate taken from the underneath side and from the outboard end thereof and with the center filler plate positioned in spaced relation below the center filler plate pocket;

FIG. 3 is a longitudinal cross-sectional view of the cast draft sill of FIG. 2, taken along the longitudinal center thereof;

FIG. 19 is an enlarged partial top plan view of the prior art center filler plate of FIG. 5;

FIG. 20 is an enlarged partial top plan view of the center filler plate of FIG. 15;

FIG. 21 is a partial sectional view of the prior art center filler plate, showing an enlarged view of the cross-section shown in FIG. 6;

DETAILED DESCRIPTION

Figure 5:
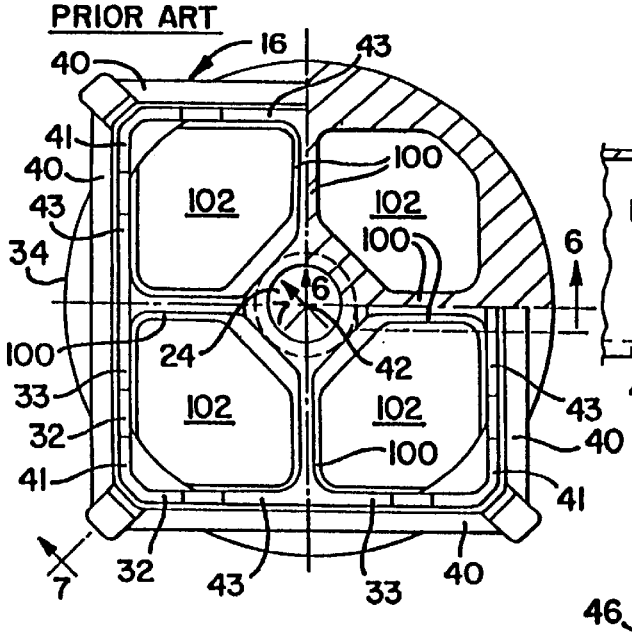
FIG. 5 PRIOR ART
FIG. 5 is a top plan view, partially in section, of a prior art center filler plate.

As shown in FIG. 1, conventional railway freight cars 10 have an underframe that includes a body bolster 12 that extends transversely to the car body and intersects the center sill of the car body. Each end of the center sill generally includes a draft sill 14 that receives draft gear and coupling mechanisms to couple the two ends of the railway freight car to other railway freight cars. The illustrated draft sill 14 includes a center filler plate 16 that is normally received within a center plate bowl 18 on a truck bolster 20. A vertical king pin 22 extends upwardly through a central bore or opening 24 in the center filler plate 16 and a vertically aligned bore or opening in the truck bolster center plate bowl 18 to provide a safety measure against separation in the event of vertical displacement in service. A similar connection supports the other end of the railway freight car on a second truck. Such connections are conventional in the industry and will not be further described. Mention herein to "top", "bottom", "horizontal" and "vertical" will be with regard to the orientation shown in and described with respect to FIG. 1.

Draft sills 14 that are designed to accept center filler plates may be of the types disclosed in U.S. Pat. No. 3,664,269 to Fillion and U.S. Pat. No. 4,252,068 to Nolan. FIGS. 2–3 of the present application illustrate a draft sill as disclosed and illustrated in U.S. Pat. No. 4,252,068 to Nolan. As there shown, this type of draft sill 14 has side walls 26 and interior transverse walls 28 that define a pocket 30. A prior art center filler plate 16 has an upwardly extending web 32 that fits within the pocket 30 in the draft sill 16.

The web 32 is part of a four-sided base 33 above a center plate bowl 34. The center plate bowl has a bottom, horizontal load-bearing surface 36. The center plate bowl 34 of the center filler plate 16 is outside of the draft sill pocket and is received in the mating female center plate bowl 18 on the railway car truck bolster 20, and the bearing surface 36 bears against a horizontal bearing surface in the female center plate bowl 18.

Figure 4:
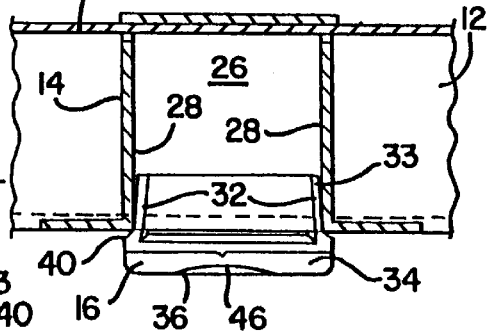
FIG. 4 PRIOR ART
FIG. 4 is a sectional elevation of a portion of the draft sill and center filler plate assembly of FIG. 1.

As shown in FIGS. 2 and 4–9 , the prior art center filler plates 16 typically had flanges 40 around the outer periphery of the sides of the base 33. Conventionally, the flanges 40 were welded to the draft sill 14 to secure the center filler plate 16 to the sill 14. FIGS. 1 and 4 illustrate a center filler plate 16 in place within the center plate pocket 30 of a conventional draft sill 14.

As shown in FIGS. 6–9, conventional prior art center filler plates 16 also had feet 41 at the four corners of the base 33, with depressions 43 between the feet 41. The depressions 43 served as handholds for lifting the center filler plates 16 that were stacked on the feet 41.

Figure 8:
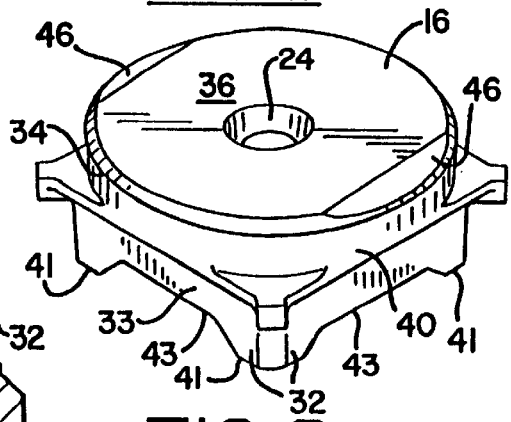
FIG. 8 PRIOR ART
FIG. 8 is perspective view of the prior art center filler plate of FIG. 5, with the center filler plate inverted to show the bottom side of the center filler plate of FIG. 5.
Figure 6:
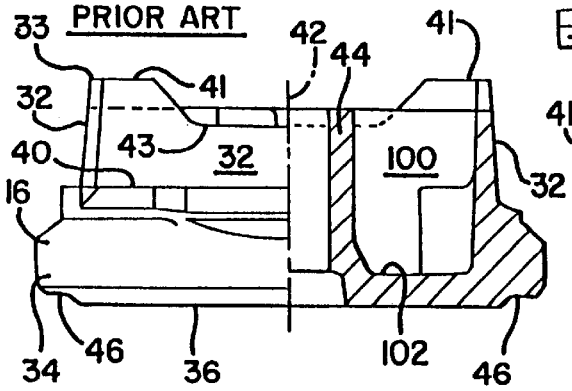
FIG. 6 PRIOR ART
FIG. 6 is an elevation in partial section of the prior art center filler plate of FIG. 5, taken along line 6—6 of FIG. 5.
Figure 9:
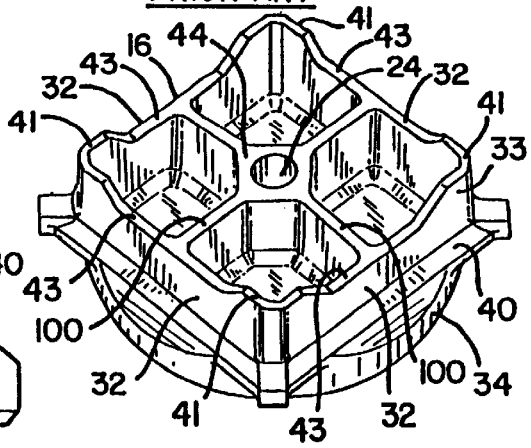
FIG. 9 PRIOR ART
FIG. 9 is a perspective view of the prior art center filler plate of FIG. 5, showing the top side of the center filler plate of FIG. 5.
Figure 7:
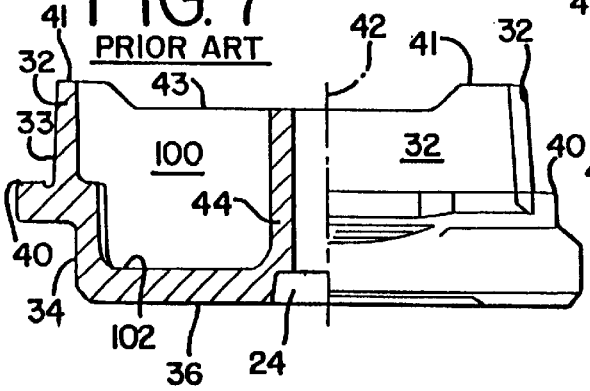
FIG. 7 PRIOR ART
FIG. 7 is an elevation in partial section of the prior art center filler plate of FIG. 5, taken along line 7—7 of FIG. 5.

The bearing surface 36 of the prior art center filler plate 16 has the central king pin hole 24 at the center of the bearing surface 36. As shown in FIGS. 6–7, the center of the king pin hole 24 is aligned with a central vertical or longitudinal axis 42 of a hollow hub 44. As shown in FIGS. 2 and 8, prior art center filler plates 16 had two reliefs 46 in the bottom face so that the horizontal load-bearing surface 36 was less than a complete circle.

Figure 13:
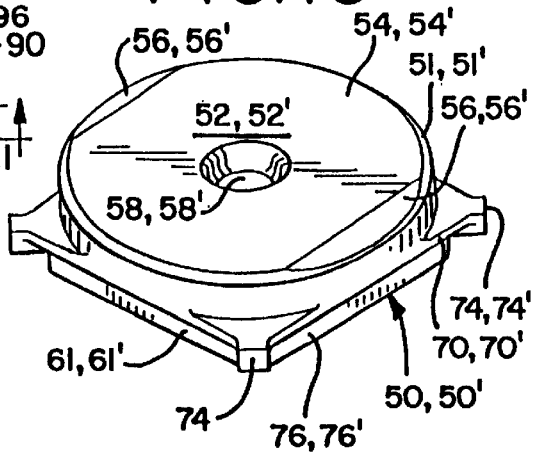
FIG. 13 is a perspective view of both embodiments of the center filler plates of the present invention, with the center filler plate inverted to show the bottom side of the center filler plate.
Figure 11:
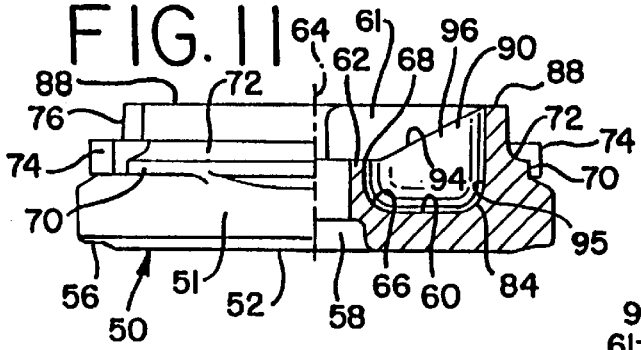
FIG. 11 is an elevation in partial section of the center filler plate of FIG. 10, taken along line 11—11 of FIG. 10.
Figure 14:
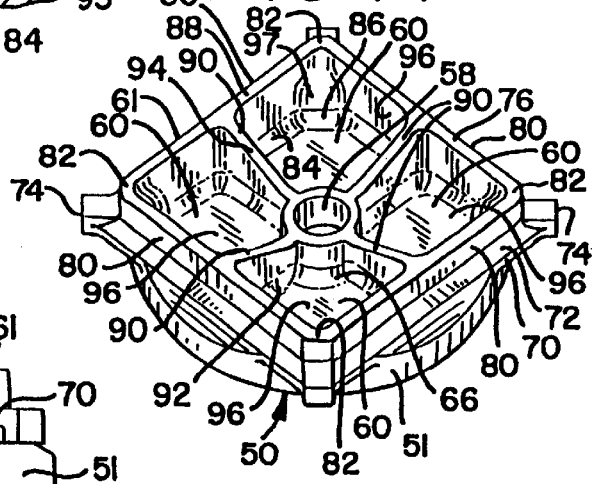
FIG. 14 is a perspective view of the center filler plate of FIG. 10, showing the top side of the center filler plate.
Figure 12:
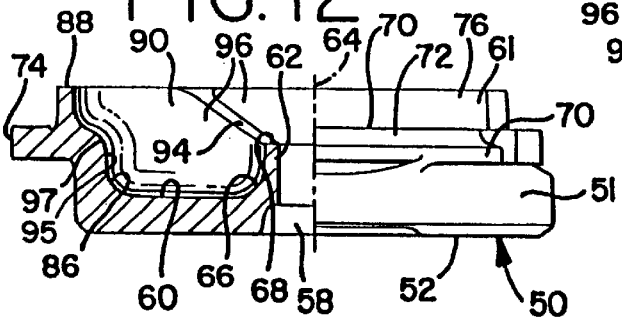
FIG. 12 is an elevation in partial section of the center filler plate of FIG. 10, taken along line 12—12 of FIG. 10.

Two embodiments of the center filler plates 50, 50' of the present invention are shown in FIGS. 10–18, 20, 22–23 and 25. The illustrated embodiments of the center filler plates of the present invention may be used with conventional draft sills 14, such as those illustrated in FIGS. 2–3, as well as other draft sill designs. The center filler plates 50, 50' of the present invention may be used with cast as well as fabricated draft sills. The first embodiment of the center filler plate 50 of the present invention is illustrated in FIGS. 10–14 and 22. The second embodiment of the center filler plate 50' of the present invention is illustrated in FIGS. 13, 15–18, 20, 23 and 25. In the inverted position, as shown in FIG. 13, the exteriors of both embodiments of the center filler plate of the present invention are the same, and reference numbers for both embodiments are used in FIG. 13.

In both embodiments of the present invention, the center filler plate 50, 50' has a center plate bowl 51, 51' that includes a substantially horizontal exterior bearing surface 52, 52'. As shown in FIG. 13, the exterior bearing surface 52, 52' is part of a generally circular bottom surface 54, 54', and has recesses 56, 56' as in the prior art center filler plates. Both embodiments also have a king pin hole 58, 58' as in conventional center filler plates, centered on the bearing surface 52, 52'. As shown in FIGS. 10–12, 14 and 15–18, opposite the exterior bearing surface 52, 52', each embodiment has a plurality of substantially horizontal interior center plate bowl surfaces 60, 60'. As shown in FIGS. 10, 14, 15 and 18, there are four interior center plate bowl surfaces 60, 60' that are substantially parallel to the horizontal exterior bearing surfaces 52, 52' of the center plate bowl 51, 51'. The references to "interior" and "exterior" are to the position of the surfaces 52, 52', 60 and 60' when mounted on a draft sill, the interior surfaces 60, 60' facing the pocket 30 of the draft sill and the exterior surfaces 52, 52' facing outward and downward to be received in the truck bolster center plate bowl 18.

Each embodiment of the center filler plate 50, 50' of the present invention has an integral center plate base 61, 61' that includes a hollow hub 62, 62' to receive at least a part of a king pin. As shown in FIGS. 10–12, 15–17, 20 and 22–23, each hub 62, 62' has a central vertical or longitudinal axis 64, 64'. The central axes 64, 64' of the hubs 62, 62' are perpendicular to and intersect the horizontal exterior bearing surfaces 52, 52' of both embodiments, and are centered in the center of the king pin holes 58, 58'. The hubs 62, 62' join the respective interior center plate bowl surfaces 60, 60' of the center filler plates 50, 50' along radii 66, 66', and have tops 68, 68' opposite the junctures with the interior center plate bowl surfaces 60, 60'.

The center plate base 61, 61' of each illustrated embodiment also includes four flanges 70, 70', each having a welding surface 72, 72' for welding the center filler plate to the railway car center or draft sill 14. There are positioning pads 74, 74' as in the prior art at the intersections of the four flanges.

In each embodiment, the base 61, 61' includes a web 76, 76' that extends upward from the flanges 70, 70'. The webs 76, 76' have a plurality of sides 80, 80'. In the illustrated embodiments, there are four sides 80, 80', and each side 80, 80' of the web 76, 76' has about the same length. Opposite sides of the web are parallel to each other along substantial parts of their lengths, and adjacent sides are generally perpendicular to each other along substantial parts of their lengths. The four sides intersect at four corners 82, 82' that define curved surfaces. The web corners 82, 82' are generally aligned with the positioning pads 74, 74'. The webs 76, 76' join the interior center plate bowl surfaces 60, 60' along radii 84, 84' along their straight sections and along radii 86, 86' at the corners 82, 82'. The webs 76, 76' have tops 88, 88' opposite the junctures of the sides 80, 80' with the interior center plate bowl surfaces 60, 60'.

Figure 10:
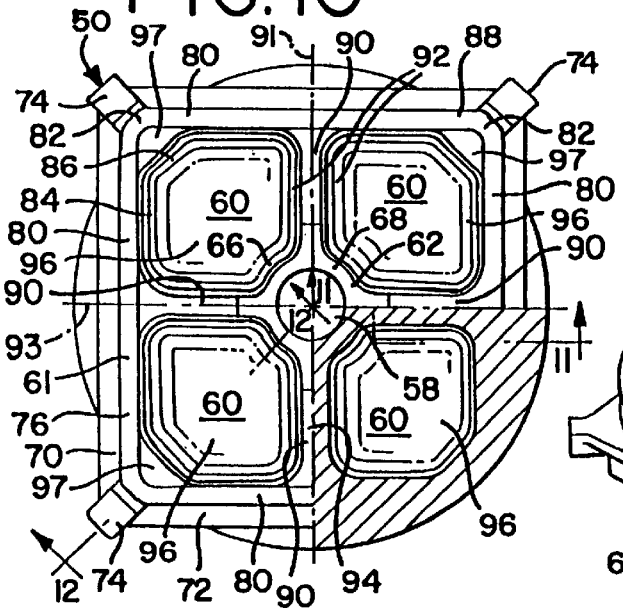
FIG. 10 is a top plan view, partially on section, of a first embodiment of the center filler plate of the present invention.
Figure 15:
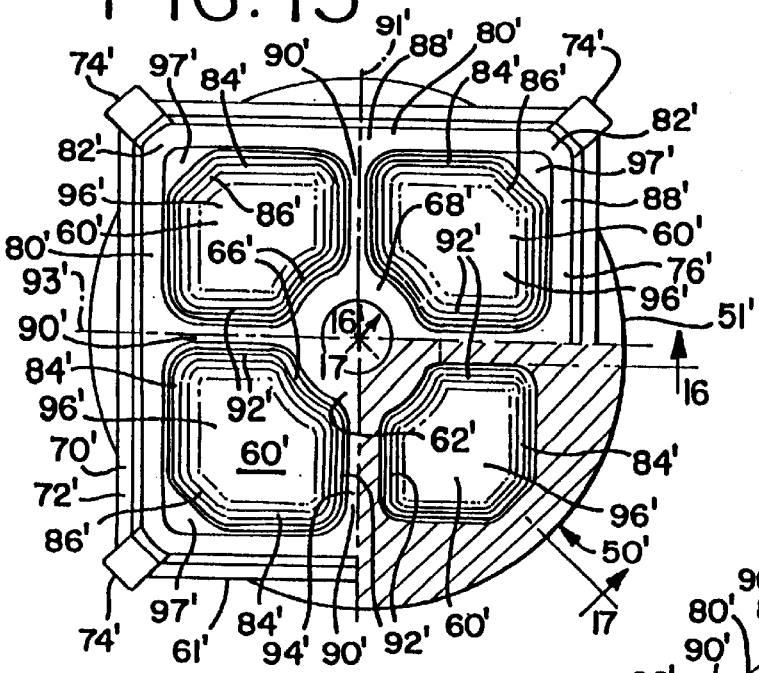
FIG. 15 is a top plan view, partially in section, of a second embodiment of the center filler plate of the present invention.
Figure 18:
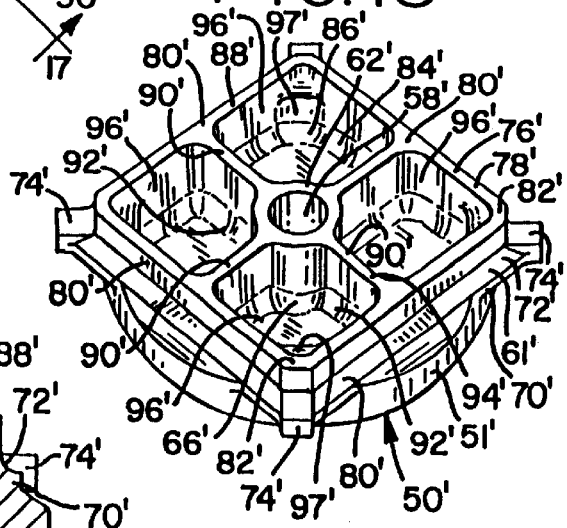
FIG. 18 is a perspective view of the center filler plate of FIG. 15, showing the top side of the center filler plate.
Figure 16:
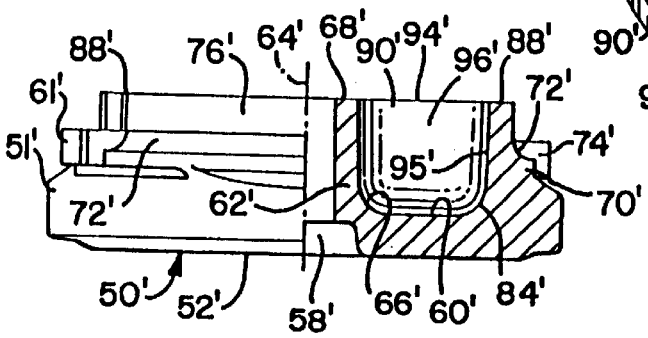
FIG. 16 is an elevation in partial section of the center filler plate of FIG. 15, taken along line 16—16 of FIG. 15.
Figure 17:
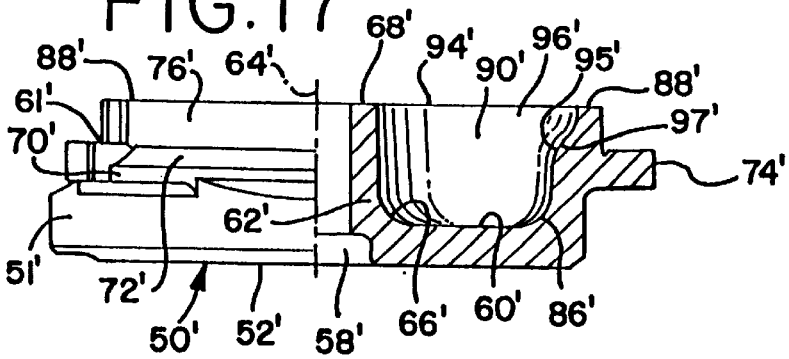
FIG. 17 is an elevation in partial section of the center filler plate of FIG. 15, taken along line 17—17 of FIG. 15.

In each embodiment, a plurality of spaced ribs 90, 90' extend radially outward from the hub 62, 62' to the web 76, 76'. The ribs 90, 90', webs 76, 76', flanges 70, 70' and center plate bowls 51, 51' are integral in each illustrated embodiment. As shown in FIGS. 10 and 15, in each of the illustrated embodiments, there are four ribs 90, 90' centered on two perpendicular vertical planes 91, 91', 93, 93' that intersect at the central vertical axes 64, 64' of the hubs 62, 62'. In the illustrated embodiments, each rib 90, 90' joins one side 80, 80' of the web 76 midway between the corners 82, 82' of that side. As shown in FIGS. 10, 14, 15 and 18, each rib 90, 90' joins two adjacent interior center plate bowl surfaces 60, 60' in radii 92, 92', and each rib has a top 94, 94' opposite the junctures with the interior center plate bowl surfaces 60, 60'.

Each web side 80, 80' has interior surfaces 95, 95' that extend from the tops 88, 88' of the web 76, 76' to join the center plate bowl interior surfaces 60, 60' along the radii 84, 84' along the straight sections and the radii 86, 86' at the corners. Each web side is divided in two on the interior side by one end of one rib 90, 90'. The interior surfaces 95, 95' of the webs 76, 76' define curved ledges 97, 97' at the corners 82, 82' and aligned with the positioning pads 74, 74'.

In each illustrated embodiment, at least part of the hub 62, 62' extends between adjacent ribs 90, 90'. And in each illustrated embodiment, at least part of the web 76, 76' extends between the adjacent ribs 90, 90'.

Each embodiment of the center filler plate 50, 50' of the present invention has four pockets 96, 96'. Each pocket 96, 96' corresponds with one of the interior center plate bowl surfaces 60, 60'. Each pocket 96, 96' extends along at least part of one rib 90, 90', along at least part of the hub 62, 62', along at least part of the next adjacent rib 90, 90', and along at least part of the web 76, 76'. In the illustrated embodiments, the each pocket extends along parts of two intersecting sides 80, 80' of the web 76, 76' and one corner 82, 82' of the web. Each illustrated pocket includes one of the ledges 97, 97' at the corners 82, 82' of the webs 76, 76'. Thus, each illustrated pocket 96, 96' extends horizontally between at least one pair of adjacent ribs, the part of the web extending between those ribs, the part of the hub extending between those ribs, and the interior center plate bowl surfaces 60, 60' joined by radii to the adjacent ribs, part of the web and part of the hub. Each pocket 96, 96' extends vertically from the levels of the tops 68, 68', 88, 88', 94, 94' of the hub 62, web 76, 76' and ribs 90, 90' to the level of the interior center plate bowl surface 60, 60' lying between the adjacent ribs, web and hub.

Comparing the center filler plates 50, 50' of the present invention to the center filler plates 16 of the prior art illustrated in FIGS. 2 and 4–9, the center filler plates of the present invention have shallower pockets, thicker ribs, and greater radii of curvature at the radii at the intersections of the ribs, web, hub and interior center plate bowl surfaces. These differences result in a center filler plate that can be more easily finished, with easier removal of any burned-in sand in the casting.

This improvement in manufacturability is achieved without sacrificing the needed strength for the center filler plate. Although there may be strength differences from the prior art, the present invention is expected to provide adequate strength. And if there are undesirable stresses, steps may be taken to reduce such stresses, such as by including an annular wear element in the truck bolster center plate bowl to deflect loads to the perimeter of the center plate bowl surfaces 52, 52'.

The differences in the structures can be seen from a comparison of FIGS. 19–25. It should be understood that the drawings are not drawn to scale, and that the dimensions specified below are the appropriate dimensions for the prior art center filler plates and the center filler plates of the present invention.

Figure 25:
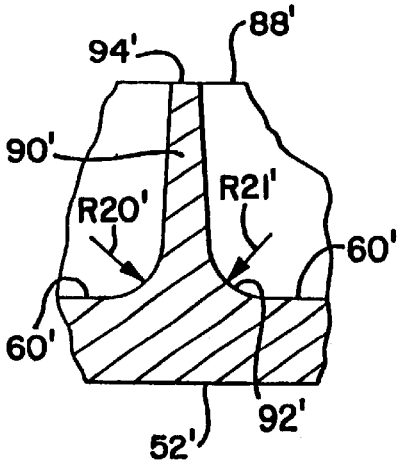
FIG. 25 is a partial sectional view of the center filler plate of FIG. 20 taken along line 25—25 of FIG. 20.

First, the center filler plates of one of the illustrated embodiments of the present invention have thicker ribs than in the prior art. As shown in FIGS. 20 and 25, in the illustrated embodiments of the present invention, the ribs 90, 90' have a minimum thickness T1 at the tops 94' of the ribs. This thickness is nominally 0.6875 inch. From this thickness, the ribs thicken downward toward the radii 92' joining the ribs 90' to the two adjacent interior center plate bowl surfaces 60'. The ribs 90 of the embodiment illustrated in FIGS. 10–12, 14 and 22 may also be thicker than standard prior art center plate ribs, and may also have a thickness of 0.6875 inch or more. In contrast, in the prior art center filler plate shown in FIG. 19, the ribs 100 have a nominal thickness T2 of 0.50 inch at the tops of the ribs, and thicken downward toward the interior center plate bowl surfaces 102. It should be understood that the thicker ribs of the illustrated embodiments of the present invention may be used with other features of the invention, but that the invention is not limited to center filler plates with thicker ribs unless expressly set forth in the claims. Moreover, the dimensions given for the illustrated embodiments of the center filler plates are given for purposes of illustration only; the present invention is not limited to any particular dimension unless expressly set forth in the claims.

In the illustrated embodiments of the present invention, the walls of the hubs 62, 62' are also thickened compared to the prior art. The hub wall thickness, measured radially midway between the ribs 90, 90', as shown at T3 in FIG. 20, in the illustrated embodiments is from 0.655 to 0.78 inch, nominally. In contrast, in the prior art the hub wall thickness, measured midway between the ribs, as shown at T4 in FIG. 19, was typically 0.50 inch, nominally. The outer walls of the hubs of the present invention are also curved, as opposed to the straight walls of the illustrated prior art hubs. It should be understood that the thicker hubs and curved hubs of the illustrated embodiments of the present invention may be used with other features of the invention, but that the invention is not limited to center filler plates with thicker or curved hubs unless expressly set forth in the claims. Moreover, the dimensions given for the illustrated embodiments of the center filler plates are given for purposes of illustration only; the present invention is not limited to any particular dimension unless expressly set forth in the claims.

Next, considering the radii joining the hubs, ribs and webs of the illustrated embodiments of the invention, larger radii of curvature are provided than in the prior art. As shown in FIG. 20, in the present invention, the radii joining the hubs 62' to the ribs 90', have radii of curvature designated R1' and R2'; these radii R1' and R2' are each a nominal one inch. The radii joining the ribs 90' to the web 76' have radii of curvature designated R3' and R4' in FIG. 20; these radii of curvature are also a nominal one inch in the illustrated embodiment. The radii at the corners 82' of the web 76' have radii of curvature designated R5' and R6' in FIG. 20; these radii of curvature are all a nominal one inch in the illustrated embodiment. The other embodiment of the invention would also have radii of curvature of nominal one inch at these locations. In contrast, in the prior art, the radii at analogous locations have radii of curvature, designated R7–R11 in FIG. 19, of nominal 0.50 inch. It should be understood that the radii of the illustrated embodiments of the present invention may be used with other features of the invention, but that the invention is not limited to center filler plates with these larger radii unless expressly set forth in the claims. Moreover, the dimensions given for the radii of the illustrated embodiments of the center filler plates are given for purposes of illustration only; the present invention is not limited to any particular radius dimension unless expressly set forth in the claims.

Figure 22:
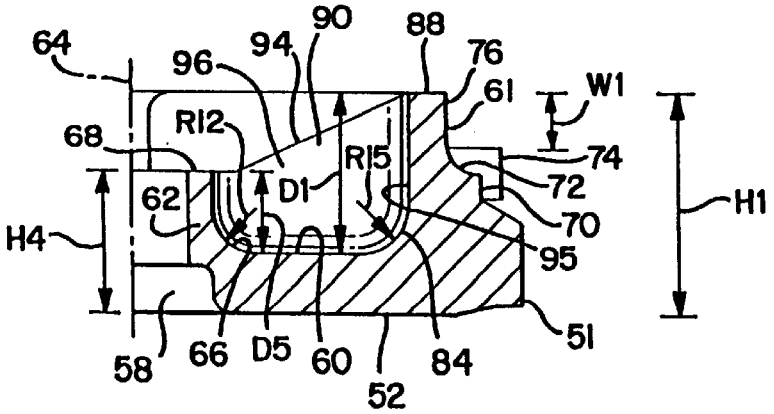
FIG. 22 is a partial sectional view of the center filler plate of FIG. 10, showing an enlarged view of the cross-section shown in FIG. 11.
Figure 23:
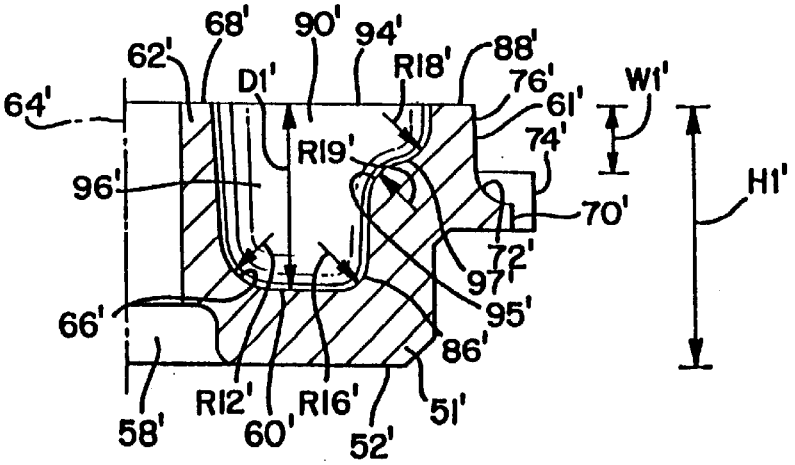
FIG. 23 is a partial sectional view of the center filler plate of FIG. 20, showing an enlarged view of the cross-section shown in FIG. 17.
Figure 24:
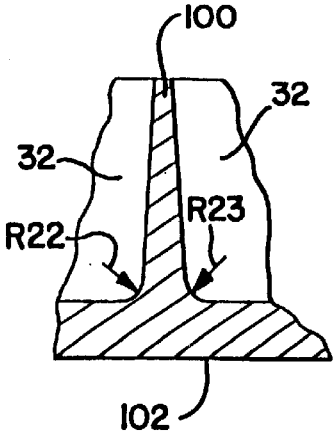
FIG. 24 PRIOR ART
FIG. 24 is a partial sectional view of the prior art center filler plate taken along line 24—24 of FIG. 19.

Next considering the radii 66, 66' joining the hubs 62, 62' to the interior surfaces 60, 60' of the center plate bowls, larger radii of curvature are provided than in the prior art. In FIGS. 22 and 23, these larger radii of curvature are designated R12 and R12', and are nominally one inch. In contrast, in the prior art, the analogous radii of curvature have been nominally 0.50 inch, as shown at R13 and R14 in FIG. 21, and have been joined by a straight segment 99. It should be understood that the radii of the illustrated embodiments of the present invention may be used with other features of the invention, but that the invention is not limited to center filler plates with these larger radii unless expressly set forth in the claims. Moreover, the dimensions given for the radii of the illustrated embodiments of the center filler plates are given for purposes of illustration only; the present invention is not limited to any particular radius dimension unless expressly set forth in the claims.

Next considering the radii 84, 84' and 86, 86' joining the interior center plate bowl surfaces 60, 60' to the interior surfaces 95, 95' of the web 76, 76', larger radii of curvature are provided than in the prior art. In FIGS. 22 and 23, these larger radii of curvature are designated R15 and R16', and are nominally one inch. In contrast, in the prior art, the analogous radii of curvature have been nominally 0.50 inch; one of the radii is designated R17 in FIG. 21. It should be understood that the radii of the illustrated embodiments of the present invention may be used with other features of the invention, but that the invention is not limited to center filler plates with these larger radii unless expressly set forth in the claims. Moreover, the dimensions given for the radii of the illustrated embodiments of the center filler plates are given for purposes of illustration only; the present invention is not limited to any particular radius dimension unless expressly set forth in the claims.

In the illustrated embodiments of the present invention, the curvature of the web interior surface 95, 95' at the corners 82, 82' is also formed by two curves, each having a radius of curvature of one inch, nominally. These radii are shown in FIG. 23 at R18' and R19'. The radii shown at R18' and R19' define the ledge 97' at that comer of the web. The interior surfaces 95 of the web 76 at the corners of the other illustrated embodiment of the present invention would also have two one-inch radius curves to define the ledge 97. In the prior art center filler plates, the analogous curves have had radii of 0.50 inch, nominally. It should be understood that the radii of the web surfaces 95, 95' of the illustrated embodiments of the present invention may be used with other features of the invention, but that the invention is not limited to center filler plates with these web surfaces unless expressly set forth in the claims. Moreover, the dimensions given for the radii of the illustrated embodiments of the web surfaces are given for purposes of illustration only; the present invention is not limited to any particular radius dimension unless expressly set forth in the claims.

Next considering the radii 92, 92' joining two interior center plate bowl surfaces 60, 60' to the ribs 90, 90', the radii of curvature in the illustrated embodiments are larger than in the prior art. These larger radii of curvature are shown at R20' and R21' in FIG. 25, and are nominally one inch. The radii in the other embodiment are also one inch nominally. In contrast, in the prior art, shown in FIG. 24, the radii at the analogous positions shown at R22 and R23, are nominally 0.50 inch. It should be understood that the radii of the illustrated embodiments of the present invention may be used with other features of the invention, but that the invention is not limited to center filler plates with these larger radii unless expressly set forth in the claims. Moreover, the dimensions given for the radii of the illustrated embodiments of the center filler plates are given for purposes of illustration only; the present invention is not limited to any particular radius dimension unless expressly set forth in the claims.

The heights of the illustrated center filler plates of the present invention are less than the height of the prior art center filler plate. The center filler plates of the present invention have vertical heights along lines parallel to the central longitudinal axes 64, 64' of the hubs 62, 62'. The heights are measured from the levels of the exterior bearing surfaces 52, 52' of the center plate bowls 51, 51' to the levels of the tops 88, 88' of the webs 76, 76' of the center plate bases 61, 61'. The maximum height is at the level of the tops 88, 88' of the webs 76, 76' spaced vertically furthest from the levels of the exterior bearing surfaces 52, 52' of the center plate bowls 51, 51'. These maximum heights are designated H1 and H1' in FIGS. 22 and 23. In the illustrated embodiments, this dimension ranges from 4.56 to 4.81 nominal inches. The webs 76, 76' have exterior vertical heights, along lines parallel to the central longitudinal axes 64, 64' of the hubs 62, 62'. The exterior web heights are from the levels of the flanges 70, 70' to the levels of the tops 88, 88' of the webs 76, 76'. More particularly, the exterior web heights are measured from the levels of the tops of the welding surfaces of the flanges 70, 70', at the level of the tops of the positioning pads 74, 74'. The maximum exterior web heights are at the levels of the tops of the webs spaced vertically furthest from the levels of the exterior bearing surfaces 52, 52' of the center plate bowls 51, 51'. The maximum exterior web height is designated W1 and W1' in FIGS. 22 and 23. In the illustrated embodiments, this dimension is 1.25 nominal inches.

In contrast to the illustrated embodiments of the present invention, in the prior art, the maximum heights of the center filler plates have been at the levels of the feet 41 at the corners of the webs. These maximum heights, shown at H2 in FIG. 21, have typically ranged from 6¼ to 6.94 nominal inches. The heights at the levels of the tops of the webs in the depressions 43 between the feet 41 have typically been 5.25 to 5.75 nominal inches, shown at H3 in FIG. 21. Typical prior art exterior web heights have ranged from a maximum of 3.38 nominal inches at the feet 41 at the levels of the corners, shown at W2 in FIG. 21, to a minimum of 1.94 to 2.88 nominal inches at the levels of the depressions 43 along the web between the feet 41, shown at W3 in FIG. 21.

It should be understood that the center filler plate heights and exterior web heights of the illustrated embodiments of the present invention may be used with other features of the invention, but that the invention is not limited to center filler plates with these heights unless expressly set forth in the claims. Moreover, the dimensions given for the heights of the illustrated embodiments of the center filler plates are given for purposes of illustration only; the present invention is not limited to any particular height dimension unless expressly set forth in the claims.

The vertical heights of the center filler plates 50, 50' from the levels of the exterior bearing surfaces 52, 52' to the levels of the flanges 70, 70' are about the same in both illustrated embodiments of the present invention and in the typical prior art center filler plate. Thus, the prior art center filler plates and center filler plates of the present invention both provide a substantially similar exterior profile when mounted on a draft sill. Accordingly, the center filler plates of the present invention should be interchangeable with prior art center filler plates to maintain the same distance from the track to the draft sill.

Thus, it can be seen that in the illustrated embodiments of the present invention, the center plate base 61, 61' comprises a smaller part of the height of the center filler plate than in the prior art. In the prior art, the ratio of the maximum height of the center filler plate to the maximum exterior height of the web may typically range from about 1.85:1 to 2.05:1 at the corners of the center filler plates. But in the illustrated embodiments of the present invention, the ratios of the maximum heights of the center filler plates to the maximum heights of the webs is at least three to one: more specifically, the ratios in the illustrated embodiments are 3.65:1 and 3.85:1. The practical result of these shorter base sections is that the height of the web received within the draft sill pocket is less than in the prior art. However, particularly if the ribs are thickened as described above, this reduction should not adversely affect the strength of the center filler plates. It should be understood that the height ratios of the illustrated embodiments of the present invention may be used with other features of the invention, but that the invention is not limited to center filler plates with these height rations unless expressly set forth in the claims. Moreover, the values given for the height ratios of the illustrated embodiments of the center filler plates are given for purposes of illustration only; the present invention is not limited to any particular height ratio unless expressly set forth in the claims.

The illustrated embodiments of the present invention provide shallower pockets 96, 96' to facilitate removal of the casting from the molding sand after casting, and more particularly to facilitate removal of any burned-in sand from castings. The pockets 96, 96' of the center filler plates 50, 50' of the present invention have vertical depths, along lines parallel to the central longitudinal axes 64, 64' of the hubs 62, 62'. In the embodiment of FIGS. 10–12, 14 and 22, the maximum vertical pocket depths are from the levels of the interior center plate bowl surfaces 60 to the levels of the tops 88' of the webs 76 at the comers 82 of the center filler plates. For each pocket 96, the maximum depth is at the level of the tops 88 of the webs 76 spaced furthest from the level of the interior center plate bowl surfaces 60. In the embodiment of FIGS. 15–18, 20 and 23, the maximum vertical depth from the levels of the interior center plate bowl surfaces 60' is the same at the levels of the tops 68', 88', 94' of the hub 62, web and ribs. For each pocket 96', the maximum depth is at the level of the tops 68', 88' and 94' of the hub 62, web 76' and ribs 90' spaced furthest from the level of the interior center plate bowl surfaces 60'. The maximum depth is designated D1 and D1' in FIGS. 22 and 23. In the illustrated embodiments, this dimension is less than 5 inches, and more specifically, is 3.56 nominal inches.

In contrast to the illustrated embodiments of the present invention, in the prior art, the maximum depths of the pockets of the center filler plates have been at the levels of the feet 41 at the comers of the webs. These maximum depths, shown at D2 in FIG. 21, have typically ranged from 5.25 to 5.69 (5 11/16) nominal inches. The depths from the levels of the tops of the webs in the depressions 43 between the feet 41 have typically been 4.25 to 4.75 nominal inches, shown at D3 in FIG. 21. The depths from the level of the tops of the hubs 44 and one set of ribs 100 to the level of the interior center plate bowl surfaces 102, shown at D4 in FIG. 21, have typically ranged from 4.75 to 5.25 nominal inches.

It should be understood that the pocket depths of the illustrated embodiments of the present invention may be used with other features of the invention, but that the invention is not limited to center filler plates with particular pocket depths unless expressly set forth in the claims. Moreover, the dimensions given for the pocket depths of the illustrated embodiments of the center filler plates are given for purposes of illustration only; the present invention is not limited to any particular pocket depth unless expressly set forth in the claims.

Thus, it can be seen that in the illustrated embodiments of the present invention, the pockets 96, 96' are not as deep as in the prior art. Accordingly, removal of sand, including burned-in sand, should be facilitated. The ease of removal of the sand is further improved by combining the shallow pockets with the larger radii of curvature of the present invention. In addition, the increased radii in the pockets should reduce hot spots to reduce the amount of burned-in sand. The relationship between the pocket depth and the radii of curvature can be expressed as a ratio. In the present invention, for each pocket the ratio of the maximum depth of the pocket to the minimum radius of curvature of the radii at the junctures of the hubs, ribs, web and interior surface of the center plate bowl in the pocket is less than 10 to 1, and in the illustrated embodiments is less than four to one. More particularly, in the illustrated embodiments, the ratio is 3.56:1. In contrast, in the prior art, the ratio is more typically 10.5:1 to 11.38:1. It should be understood that this ratio may be used with other feature of the present invention, but that the invention is not limited to center filler plates with these ratios unless expressly set forth in the claims. Moreover, the particular ratios are given for purposes of illustration only, and the invention is not limited to a particular ratio unless expressly set forth in the claims.

As discussed above, some prior art center filler plates had depressions or handholds 43 defined in the parallel sides of the web. Such depressions or handholds are illustrated in FIGS. 5–9 and 21 at 43, between the feet 41 at the corners of the base 33. The feet 41 and recessed handholds 43 allowed the prior art center filler plates to be stacked and stored before assembly with the draft sills, while also allowing them to be readily lifted by inserting hands or tools into the depressions or handholds 43 between the feet 41 for movement of the center filler plate toward the draft sill for assembly. Shallower recesses could be formed in the web walls of the present invention to allow for insertion of thin tools for lifting the center filler plates for assembly with the draft sills, although in both illustrated embodiments of the present invention, the tops 88, 88' of the sides 80, 80' of the webs 76, 76' each lie in a single plane. The embodiment of the present invention illustrated in FIGS. 10–14 and 22 provides an alternate design for lifting the center filler plates of the present invention.

In the embodiment of FIGS. 10–14 and 22, the vertical height of the center filler plate, parallel to the central longitudinal axis 64 of the hub 62, varies between the level of the exterior bearing surface 52 and the levels of the tops 88, 94, 68 of the web 76, ribs 90 and hub 62. The height of the center filler plate at the hub 62, shown at H4 in FIG. 22, is less than the minimum height of the center filler plate at the web 76, shown at H1 in FIG. 22. The ribs 90 taper from their maximum height at the level of the top 88 of the web 76 to their minimum heights at the hub 62. Accordingly, the depth of the pockets 96 at the hub 62, shown at D5 in FIG. 22, is less than the depth D1 at the web 76. All four ribs have the same shape in the embodiment of FIGS. 10–14 and 22. With the ribs so shaped, the center filler plates can be stacked in an inverted position, as shown in FIG. 13, with their exterior bearing surfaces 52 facing upward. A tool may be inserted through the kin pin hole 58 and then expanded once it has cleared the hub 62. The expanded tool may bear against the sloping tops 94 of the ribs 90, and then the center filler plate 50 may be lifted by lifting the tool. The center filler plate 50 may then be placed in the center filler plate pocket 30 of an inverted conventional draft sill 14. The tool may be contracted and removed through the king pin hole 58, leaving the center filler plate resting on the four positioning lugs 74 on the surface of the draft sill. The center filler plate may then be welded to the draft sill around the welding surfaces 72 of the flanges 70 in a conventional manner. The center filler plate of the embodiment of FIGS. 15–18 may also be welded to a draft sill in a conventional manner.

The tool inserted into the center filler plate kingpin hole 58 may be part of a conventional lift machine. Thus, the embodiment of FIGS. 10–14 and 22 allows for machine-assisted lifting and moving the center filler plates.

Both embodiments of the present invention may be cast of conventional materials in conventional manners. However, as compared to the prior art, with the shallower pockets 96, 96' of the present invention, the depth of the draw is decreased so that the casting may be removed from the molding sand with less breakage of the molding sand. Clean out of the pockets 96, 96' of the cast center filler plate 50, 50' is facilitated by the increased radii 66, 66', 84, 84', 86, 86', 92, 92' in the pockets 96, 96' with the decreased depth of the pockets. Thus, finishing time and difficulty are reduced.

It should be understood that the center filler plates of the present invention may be designed with standard drafts and tapers for ease of removal of the casting from the cope and drag sections of the mold. In addition, it should be understood that the benefits of the present invention may also be realized in applications using sand cores to define the pockets, enabling easier removal of sand cores from the casting. Other standard casting practices may be employed in making the molds, cores and castings.

The increased radii 66, 66', 84, 84', 86, 86', 92, 92' also serve to reduce stresses at the junctures of the respective walls of the center filler plates. And with increased thicknesses of the ribs 90, 90' and hubs 62, 62', the center filler plates of the present invention should continue to meet strength and durability requirements.

It should be understood that while the present invention provides particular advantages in making cast center filler plates, the principles may also be applied to other types of center filler plates, such as forged or machined center filler plates.

While only specific embodiments of the invention have been described and shown, it is apparent that various alternatives and modifications can be made thereto. Those skilled in the art will also recognize that certain additions can be made to the illustrative embodiments. It is, therefore, the intention in the appended claims to cover all such alternatives, modifications and additions as may fall within the true scope of the invention.

What is claimed is:

1. A center filler plate for a railway car comprising:

a center plate bowl having an exterior bearing surface and a king pin hole at the center of the bearing surface;

a center plate base on the center plate bowl, the center plate base including:

a hollow hub to receive at least a part of a king pin, said hub having a central axis intersecting said exterior bearing surface, said central axis located at the center of said king pin hole, said hub joining said center plate bowl and having a top opposite the junctures with said center plate bowl;

a plurality of ribs extending radially outward from said hollow hub, each rib joining said center plate bowl, each rib having a top opposite said center plate bowl; and a web extending between said ribs opposite said hub, said web joining said center plate bowl and having a top opposite said center plate bowl;

said center filler plate having heights between the level of the exterior bearing surface and the levels of the tops of the web, ribs and hub;

wherein the height of said center filler plate at said hub is less than the minimum height of said center filler plate at said web, the heights of said center filler plate along said ribs tapering from a maximum at the level of the top of the web to a minimum at the hub.

2. The center filler plate of claim 1 wherein a pocket extends between adjacent ribs, the part of the web extending between said adjacent ribs, the part of the hub extending between said adjacent ribs, and the part of the center plate bowl joined to said adjacent ribs, said part of the web and said part of the hub;

each of said pockets having a maximum depth from the level of the tops of at least one of said one pair of adjacent ribs, said part of the web and said part of the hub to the level of said part of the center plate bowl in the pocket; and wherein the ratio of the maximum depth of the pocket to the minimum thickness of the ribs is less than 10 to 1.

3. The center filler plate of claim 1 further including flanges around the web for welding the center filler plate to the railway car center sill, the maximum height of said web from the level of the flanges to the top of the web being less than about two inches.

* * * * *